US007100482B2

(12) United States Patent
Neumaier

(10) Patent No.: US 7,100,482 B2
(45) Date of Patent: Sep. 5, 2006

(54) ELECTRICALLY POWERED HAND-HELD SCREW DRIVER

(75) Inventor: Anton Neumaier, Fürstenfeldbruck (DE)

(73) Assignee: Hilti Aktiengesellschaft, Schaan (LI)

( * ) Notice: Subject to any disclaimer, the term of this patent is extended or adjusted under 35 U.S.C. 154(b) by 156 days.

(21) Appl. No.: 10/964,323

(22) Filed: Oct. 13, 2004

(65) Prior Publication Data

US 2005/0081688 A1 Apr. 21, 2005

(30) Foreign Application Priority Data

Oct. 18, 2003 (DE) ..... 103 48 517

(51) Int. Cl.
*B25B 23/00* (2006.01)
*B25B 23/14* (2006.01)
*B25B 23/157* (2006.01)

(52) U.S. Cl. ..... 81/429; 81/467; 81/473

(58) Field of Classification Search ..... 81/429, 81/467, 473–476; 173/2, 13, 216, 178; 192/34
See application file for complete search history.

(56) References Cited

U.S. PATENT DOCUMENTS 5,134,909 A * 8/1992 Sasaki ..... 81/473
5,372,206 A * 12/1994 Sasaki et al. ..... 173/178
5,568,849 A * 10/1996 Sasaki et al. ..... 192/34
5,601,387 A * 2/1997 Sanford et al. ..... 408/113
5,682,800 A * 11/1997 Jore ..... 81/429
5,947,210 A * 9/1999 Sasaki et al. ..... 173/178
6,109,149 A * 8/2000 Neumaier ..... 81/469
6,665,923 B1 * 12/2003 Phillips et al. ..... 29/525.11
6,851,343 B1 * 2/2005 Sasaki ..... 81/475
2002/0178877 A1 * 12/2002 Kikuchi et al. ..... 81/473

* cited by examiner

*Primary Examiner*—Lee D. Wilson
*Assistant Examiner*—Alvin J Grant
(74) *Attorney, Agent, or Firm*—Abelman, Frayne & Schwab

(57) ABSTRACT

An electrically powered, hand-held screw driver (2) has a housing (4), a depth stop (6) arranged on this housing (4), a drive motor (20), an axially displaceable tool spindle (8) operatively coupled with a tool holder (11), and a torque coupling (16) arranged between the drive motor (20) and tool spindle (8) and which has a motor-side coupling part (22) and a tool-side coupling part (24) connected to the tool spindle (8) so as to be fixed with respect to rotation relative to it. The two coupling parts (22, 24) can be made to engage with one another and the tool spindle (8) is biased away from the motor-side coupling part (22) by means of a coupling spring (34). The tool-side coupling part (24) has axial movement play (a) relative to the tool spindle (8) and is mechanically coupled with a movement transmitter that is separate from the coupling spring (34).

6 Claims, 3 Drawing Sheets

ELECTRICALLY POWERED HAND-HELD SCREW DRIVER

BACKGROUND OF THE INVENTION

The invention is directed to an electrically powered, hand-held screw driver with a housing, a depth stop arranged at the housing, a drive motor, an axially displaceable tool spindle operatively coupled with a tool holder, and a torque coupling, in the form of a claw coupling, which is arranged between the drive motor and tool spindle and has a coupling part on the motor side and a coupling part on the tool side connected with the tool spindle and fixed with respect to rotation relative to the spindle. The two coupling parts can engage with one another and the tool spindle is pretensioned or biased away from the motor-side coupling part by means of a coupling spring.

Hand-held screw drivers of the type mentioned above have the advantage that a certain screw-in depth for a fastener to be placed, for example, a self-cutting screw, can be adjusted by means of the depth stop. As soon as the depth stop contacts a surface into which the fastener is screwed, the two parts of the torque coupling are separated and the screwing-in process is halted.

DE 198 45 024 discloses a hand-held screw driver in which the torque coupling is formed by a claw coupling with engagement cams. The tool-side coupling part of the claw coupling is secured to the tool spindle in a positive engagement in axial direction. In this hand-held screw driver, as soon as the depth stop strikes the surface to be fastened during a screwing in process, the coupling part on the tool side, together with the axially displaceable tool spindle, is moved farther in the screwing-in direction relative to the housing by means of spring force. During this relative movement with respect to the housing, the tool-side coupling part is moved away from the motor-side coupling part until the two coupling parts disengage. The screwing-in process is stopped at this point.

This known procedure is disadvantageous because the motion of the tool spindle is carried out by means of the spring element and the separation of the two coupling parts is therefore carried out relatively slowly. In this way, the two coupling parts are moved together over a certain period of time in the manner of two ratchet elements, wherein the engagement cams are rotated relative to one another and accordingly strike one another repeatedly. This results in unpleasant noise and a high degree of wear on the coupling parts.

SUMMARY OF THE INVENTION

It is the object of the present invention to avoid the aforementioned disadvantages in a hand-held screw driver with torque coupling and to ensure greater user comfort and a longer operating life.

This object is met, according to the invention, in that the tool-side coupling part has axial movement play relative to the tool spindle and is mechanically coupled with a movement transmitter which is separate from the coupling spring.

In this way, it is possible to move the tool-side coupling part additionally within the limits of the axial movement play independent from the tool spindle. For this purpose, the movement transmitter can be designed in such a way that a faster separation of the torque coupling is achieved. On the one hand, this reduces the noise generated during separation, which increases user comfort, and on the other hand prolongs the life of the torque coupling and of the hand-held screw driver overall.

In a particularly preferred embodiment form, the movement transmitter is formed by a jump device or over-center mechanism which automatically jumps to a second rest position when the dead center position of a first rest position is exceeded and automatically jumps to the first rest position when the dead center position of the second rest position is exceeded. The use of the over-center mechanism makes it possible for the tool-side coupling part to jump back and forth between a first position and a second position depending on the position of the tool spindle relative to the housing and within the limits of the axial play on the tool spindle. By over-center mechanism is meant a device which stores a kinetic energy in a stable rest position and which automatically releases the kinetic energy and executes a sudden movement into another rest position when brought into a releasing position. Therefore, it is possible to make use of the sudden movement of the over-center mechanism for a fast separation of the coupling parts, so that the generation of noise can be sharply reduced. Until the depth stop comes into contact with the surface to be fastened during the screwing-in process, the motor-side coupling part is biased against the latter by the over-center mechanism in a rest position in which it is pressed against the motor-side coupling part. This ensures a reliable engagement of the coupling parts until the depth stop makes contact.

The tool-side coupling part is advantageously still engaged with the motor-side coupling part in the dead center position of the over-center mechanism. In this way, the tool-side coupling part is displaced by the over-center mechanism especially quickly over the relative position with respect to the motor-side coupling part in which the engagement means and counter-engagement means contact against one another. In addition, the movement potential of the over-center mechanism is made use of in this way for a relatively large distance between the coupling parts, which ensures a clear and reliable separation of the two coupling parts.

The over-center mechanism preferably has at least one bistable C-shaped spring element whose ends are completely fixed relative to the housing. In this way, a reliably working over-center mechanism is achieved in a simple manner.

The spring element is advantageously formed from a wire so that the over-center mechanism can be produced at low cost.

Further, a securing ring is advantageously fixedly clamped to the tool spindle and forms a stop for the tool-side coupling part in the direction of the motor-side coupling part and the spring element contacts this securing ring. In this way, the movement play of the tool-side coupling part can be adjusted especially easily. In addition, production costs can be kept low by the twofold bearing function of the securing ring.

BRIEF DESCRIPTION OF THE INVENTION

The invention will be described more fully in the following with reference to an embodiment example.

DETAILED DESCRIPTION OF THE INVENTION

Figure 1:
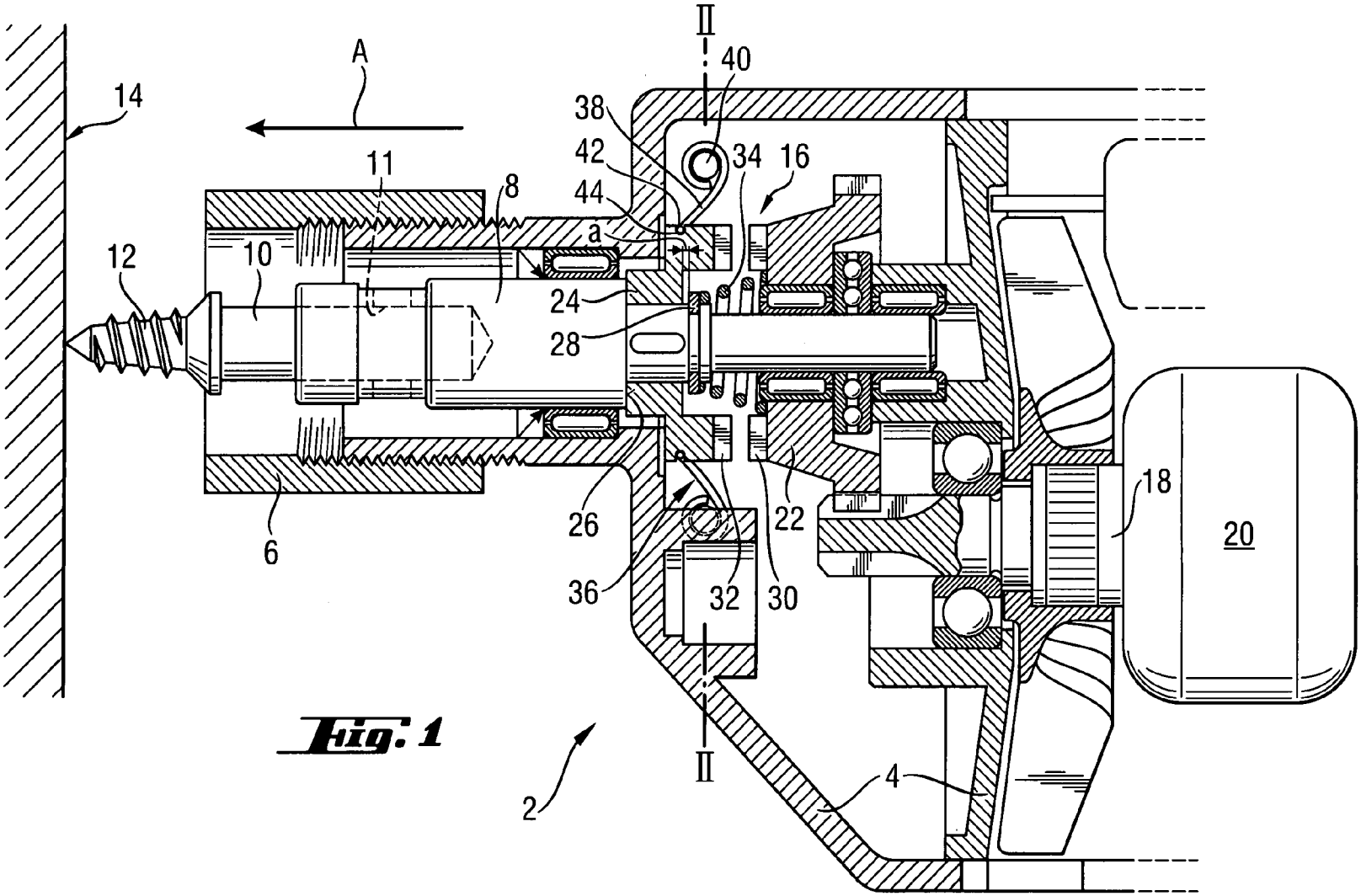
FIG. 1 is a longitudinal section through the front part of a hand-held screw driver according to the invention.

FIG. 1 shows a longitudinal section through the front portion of an electrically powered hand-held screw driver 2, e.g., a battery operated screw driver, with a housing 4. A sleeve-shaped depth stop 6 is held in an adjustable manner at the front end of the housing 4 with reference to a work direction A of the hand-held screw driver 2. This depth stop 6 encloses the front end of a tool spindle 8, with reference to the work direction A, at which a tool bit 10 is fastened in a tool holder 11. The tool bit 10 engages a fastener 12 in the form of a screw which is to be screwed into a receiving surface 14.

The tool spindle 8 is operatively coupled by a torque coupling 16 with a drive shaft 18 that is driven by a motor 20, shown schematically. For this purpose, the torque coupling 16 has a motor-side coupling part 22 which is held on the tool spindle 8 so as to be rotatable relative to the tool spindle and which is driven by the drive shaft 18.

Further, the torque coupling 16 has a tool-side coupling part 24 which is held at the tool spindle 8 so as to be fixed with respect to rotation relative to the tool spindle 8 and with an axial movement play a relative to the tool spindle 8. For this purpose, the tool-side coupling part 24 is guided in an axially displaceable manner and so as to be fixed with respect to rotation between a stop surface 26 produced by a reduced diameter and a securing ring 28 arranged at the tool spindle 8.

For the purpose of transmitting torque between the two coupling parts 22, 24, the motor-side coupling part 22 has claw-shaped engagement means 30 which project in the direction of the tool-side coupling part 24. Correspondingly claw-shaped counter-engagement means 32 which can be brought into engagement with the engagement means 30 of the motor-side coupling part 22 against the force of a coupling spring 34 are formed at the tool-side coupling part 24.

The coupling spring 34 is formed by a frustum-shaped helical spring which contacts the motor-side coupling part 22 by its larger diameter and contacts the securing ring 28 by its smaller diameter. In this way, the tool spindle 8 is biased away from the motor-side coupling part 22 by the securing ring 28 by means of the coupling spring 34.

Figure 2:
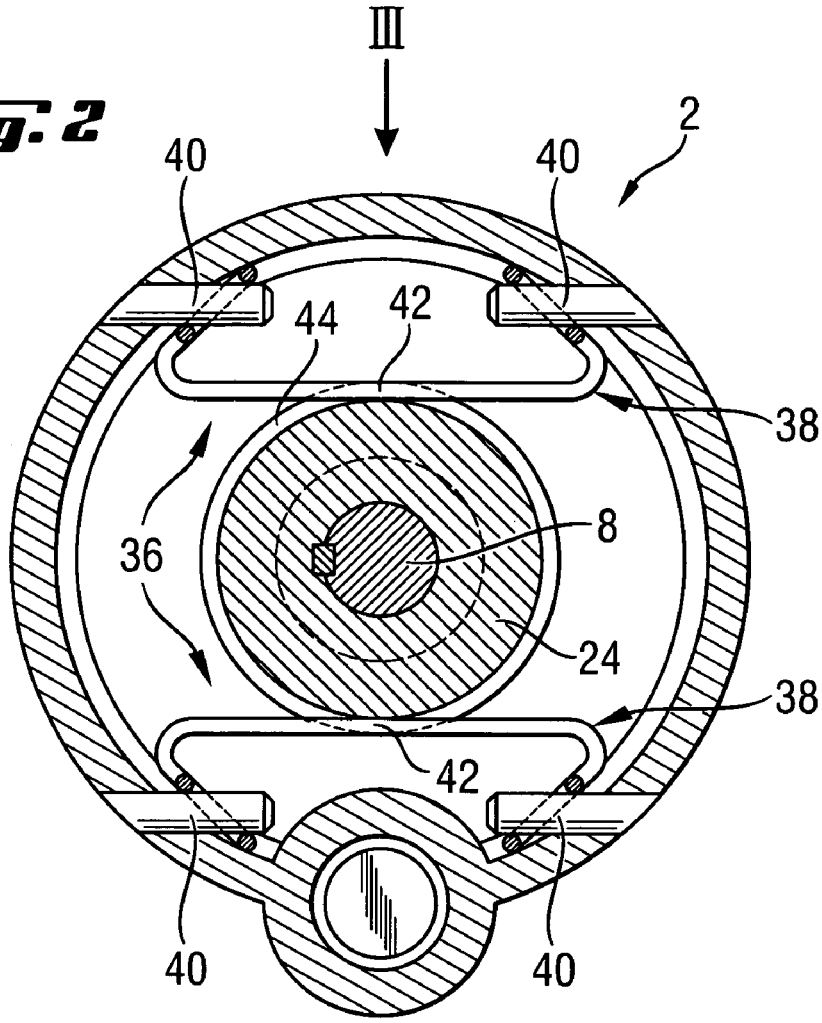
FIG. 2 is a cross section in plane II—II of FIG. 1 showing a view of an over-center mechanism of the hand-held screw driver according to FIG. 1.

An additional movement transmitter, shown particularly in FIG. 2, is provided in the form of an over-center mechanism 36 separate from the coupling spring 34. This over-center mechanism 36 has two bistable C-shaped spring elements 38 whose ends are fixed to bearing pins 40 that are fixed with respect to the housing as is shown especially in FIG. 3. The two C-shaped spring elements 38 are formed from a wire and an adjusting portion 42 thereof engages in an annular groove 44 which is formed at the circumference of the tool-side coupling part 24.

Figure 3:
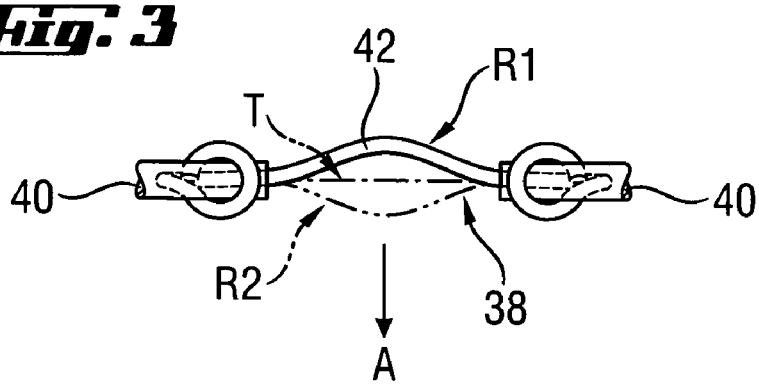
FIG. 3 shows a top view of a bistable spring element of the over-center mechanism according to FIG. 2.

As can be seen from FIG. 3, each of the two C-shaped spring elements 38 has a first rest position R1 in which it forms a bend that is oriented opposite to the work direction A. The spring element 38 can be moved by external application of force into the dead center position T shown by a dash-dot axis. As soon as the C-shaped spring element 38 is moved a short distance beyond this dead center point, it automatically jumps into a second rest position R2, shown in a dash-double-dot axis, in which the C-shaped spring element 38 forms a bend in the work direction A.

The manner of operation of the C-shaped spring elements 38 during a screwing process is described more fully in the following with reference to FIGS. 4 to 6.

Before the start of the screwing process, the hand-held screwing device 2 occupies the position shown in FIG. 1. In this position, the two coupling part 22, 24 are separated from one another by the coupling spring 34 to the extent that their engagement means 30 and counter-engagement means 32 are disengaged. The tool-side coupling part 24 is additionally pushed away from the motor-side coupling part 22 by the spring element 38 which occupies the second rest position. Consequently, no transmission of torque from the motor 20 to the tool spindle 8 via the drive shaft 28 is possible in this position.

Figure 4:
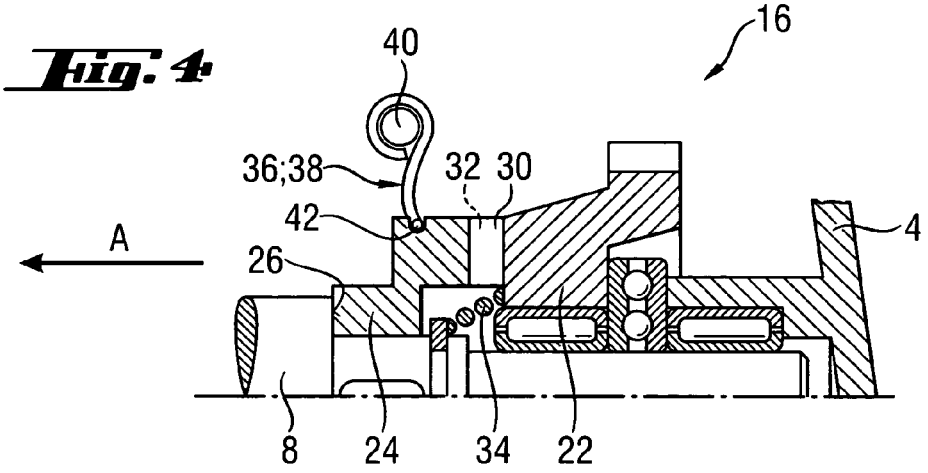
FIG. 4 shows a longitudinal section through the upper part of a torque coupling of the hand-held screw driver according to FIG. 1 in the locked-in position.

FIG. 4 shows the upper half of the torque coupling 16 in a position at the start of the screwing process in which the fastener 12 is pressed against the surface 14 by means of the hand-held screw driver 2 by the user. The pressing pressure displaces the tool spindle 8 backward relative to the housing 4 opposite to the work direction A against spring force of coupling spring 34. Together with the tool spindle 8, the tool-side coupling part 24 is also displaced in direction of the motor-side coupling part 22 through contact at the stop surface 26 of the tool spindle 8 until the engagement means 30 engage with the counter-engagement means 32 as is shown.

In addition, the adjusting portion 42 of the spring element 38 is also moved with the tool-side coupling part 24 and is displaced from the first rest position R1 beyond the dead center position T. Immediately after the dead center position T is passed, the over-center mechanism 36 automatically jumps into the second rest position R2 and presses the tool-side coupling part 24 against the motor-side coupling part 22 by means of the adjusting portion 42.

In this way, torque can now be safely transmitted from the motor 20, via the drive shaft 18 and the torque coupling 16, to the tool spindle 8, the tool bit 10 and the fastener 12 arranged at the latter. As a result of this transmitted torque, the fastener 12 progressively penetrates into the surface 14 until the depth stop 6 contacts the latter.

When the depth stop 6 contacts the surface 14, pressing pressure is no longer conveyed to the tool spindle 8. Therefore, the latter moves farther in the work direction A away from the motor-side coupling part 22 only due to the biasing by the coupling spring 34. The tool-side coupling part 24 is displaced relative to the tool spindle 8 within the limits of the axial movement play a and comes into contact with the securing ring 28 (FIG. 5). As a result of this contact, not only the tool-side coupling part 24 together with the tool spindle 8, but also the adjusting portion 42 of the spring element 38 is displaced from the rest position R1 by the tool-side coupling part 24 by means of the coupling spring 34.

Figure 5:
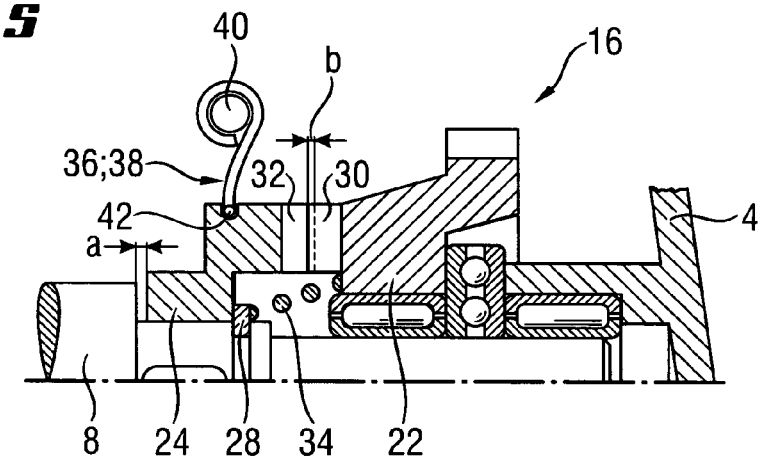
FIG. 5 shows a longitudinal section through the upper part of the torque coupling according to FIG. 4 in a dead center position.
Figure 6:
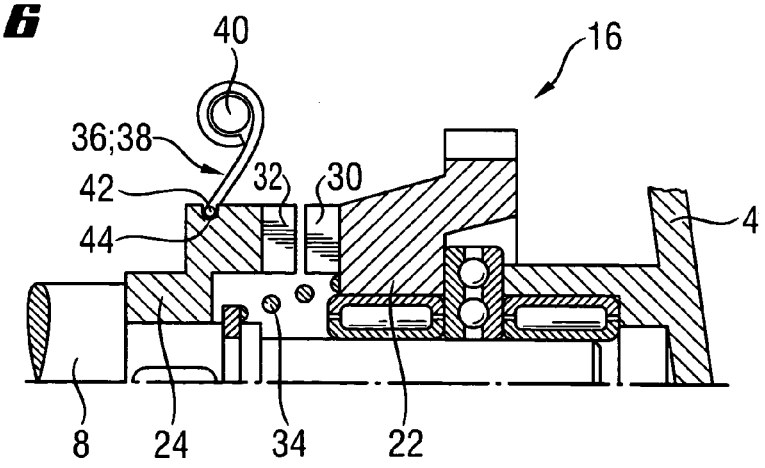
FIG. 6 shows a longitudinal section through the upper part of the torque coupling according to FIG. 4 in a separated position.

FIG. 5 shows the position of the torque coupling 16 in which the dead center position T of the over-center mechanism 36 is traversed during this displacement of the adjusting portion 42. At this point, there is a minimum engagement depth b between the engagement means 30 and the counter-engagement means 32, so that torque is still transmitted between the drive shaft 18 and the tool spindle 8.

As soon as the adjusting portion 42 has passed the dead center position T, the spring element 38 is released. As a result, the kinetic energy stored by the spring 38 in the first rest position R1 is suddenly released so that the adjusting portion 42 jumps into the second rest position R2 as is shown in FIG. 6. During this movement of the adjusting portion 42, the latter carries the tool-side coupling part 24 along with it and the latter is displaced in work direction A within the limits of the axial movement play a. The counter-engagement means 32 of the tool-side coupling part 24 is accordingly suddenly separated from the engagement means 30 of the motor-side coupling part 22.

The sudden movement of the tool-side coupling part 24 relative to the motor-side coupling part 22 described above results in a separation of the torque coupling 16 with reduced noise and reduced friction and causes the transmission of torque to stop. In this way, greater user comfort and a longer life are achieved by the hand-held screwing device 2 according to the invention.

What is claimed is:

1. Electrically powered hand-held screw driver (2) comprising a housing (4) having an axially extending work direction (A) with a leading end and a trailing end for driving screw-type fastening elements in the work direction into a receiving material (14), said housing (4) carrying a drive motor (20), a tool spindle (8) axially displaceable in the work direction and operatively coupled to a tool holder (11), and a torque coupling (16) positioned between said drive motor (20) and said tool spindle (8) and having a motor-side coupling part (22) and a tool-side coupling part (24) connected to said tool spindle (8) and fixed with respect to rotation relative to said tool spindle (8), said coupling parts (22, 24) engageable with one another and with said tool spindle (8) biased away from said motor-side coupling part (22) by a coupling spring (34), said tool-side coupling part (24) has axial movement play (a) relative to said tool spindle (8) and is mechanically coupled with a movement transmitter separate from said coupling spring (34).

2. Electrically powered hand-held screw driver, as set forth in claim 1 wherein said movement transmitter is formed by an over-center mechanism (36) comprising a first rest position (R1), a dead center position (T) and a second rest position (R2) which automatically jumps to the second rest position (R2) when movement from the first rest position exceeds the dead center position (T), and automatically jumps to the first rest position (R1) when movement from the second rest position (R2) exceeds the dead center position (T).

3. Electrically powered hand-held screw driver, as set forth in claim 2, wherein said tool-side coupling part (24) remains engaged with the motor-side coupling part (22) in the dead center position (T) of the over-center mechanism (36).

4. Electrically powered hand-held screw driver, as set forth in claim 2, wherein said over-center mechanism (36) has at least one bistable C-shaped spring element (38) having opposite ends fixed to said housing (4).

5. Electrically powered hand-held screw driver, as set forth in claim 4, wherein said spring element (38) is formed of a wire.

6. Electrically powered hand-held screw driver, as set forth in claim 4, wherein a securing ring (28) in fixedly clamped to said tool spindle (8) and forms a stop for said tool-side coupling part (24) in the direction toward said motor-side coupling (22) and said spring element (38) contacts said securing ring (28).

* * * * *